US012624529B2

(12) United States Patent
OkAMOTO

(10) Patent No.: US 12,624,529 B2
(45) Date of Patent: May 12, 2026

(54) SLOPE WORK VEHICLE

(71) Applicant: Toshihito OkAMOTO, Chiba (JP)

(72) Inventor: Toshihito OkAMOTO, Chiba (JP)

( * ) Notice: Subject to any disclaimer, the term of this patent is extended or adjusted under 35 U.S.C. 154(b) by 389 days.

(21) Appl. No.: 18/279,640

(22) PCT Filed: Apr. 19, 2021

(86) PCT No.: PCT/JP2021/015797
§ 371 (c)(1),
(2) Date: Aug. 31, 2023

(87) PCT Pub. No.: WO2022/224292
PCT Pub. Date: Oct. 27, 2022

(65) Prior Publication Data

US 2024/0133159 A1 Apr. 25, 2024
US 2024/0229421 A9 Jul. 11, 2024

(51) Int. Cl.
*E02F 9/22* (2006.01)
*E02F 5/00* (2006.01)

(52) U.S. Cl.
CPC ..... *E02F 9/2239* (2013.01); *E02F 5/00* (2013.01); *E02F 9/2292* (2013.01)

(58) Field of Classification Search
CPC ..... E02F 9/2239; E02F 9/2292; E02F 5/00
See application file for complete search history.

(56) References Cited

U.S. PATENT DOCUMENTS

2017/0284064 A1* 10/2017 Hijikata et al. ..... E02F 9/2267
2019/0390434 A1* 12/2019 Misaki ..... E02F 9/2228

FOREIGN PATENT DOCUMENTS

JP H05118053 A * 5/1993 ..... E02F 3/32
JP 2013-119739 A 6/2013
JP 2017-145087 A 8/2017
JP 2019-218794 A 12/2019
JP 6726475 B2 7/2020

OTHER PUBLICATIONS

Okamoto, Toshihito, "Earthwork Machine for Slope Face and the Like", Japanese Patent Document JP-H05118053-A, machine translation. (Year: 1993).*

* cited by examiner

*Primary Examiner* — Tara Mayo
(74) *Attorney, Agent, or Firm* — Norris McLaughlin, P.A.

(57) ABSTRACT

A slope work vehicle has a hydraulic traveling apparatus actuator and a winch provided with a hydraulic winch actuator upon which is wound a cable for anchoring the vehicle to a slope. A hydraulic pump pumps oil to both actuators in parallel. A controller controls a flow adjustment valve provided between the hydraulic pump and the traveling apparatus actuator. A tilt sensor provided on the work vehicle main body that senses tilt of the work vehicle is connected to the controller so that the supply of oil is so apportioned between the travelling apparatus actuator and the winch actuator such that the work vehicle does not fall from a slope upon which the work vehicle is situated.

3 Claims, 10 Drawing Sheets

SLOPE WORK VEHICLE

BACKGROUND OF THE INVENTION

1. Field of the Invention

The present invention relates to a slope work vehicle that moves on a slope and performs work such as drilling.

2. Description of the Related Art

Conventionally, as a slope work vehicle that travels on a slope or the like by being suspended and towed by a wire of a winch, and performs work on the slope, "a vehicle body that includes a caterpillar, a winch, and a work machine; an engine that is attached to a section near a rear portion of a base plate of the vehicle body; a hydraulic pump that is driven by the engine being driven; a hydraulic drive apparatus that is supplied pressurized working oil from the hydraulic pump through a hydraulic supply hose; and a slope work vehicle that supplies pressurized working oil from the hydraulic drive apparatus to a traveling apparatus of the vehicle body and the like" is known.

In addition, as a hydraulic valve for a slope work vehicle that uses the same hydraulic circuit for a winch and a traveling apparatus, and enables automatic control of hydraulic pressure, "a hydraulic valve for a slope work vehicle that is provided between a traveling apparatus hydraulic actuator and a winch hydraulic actuator of the slope work vehicle, and a hydraulic pump that pumps oil for operating the traveling apparatus hydraulic actuator and the winch hydraulic actuator, the hydraulic valve for a slope work vehicle being configured by: a valve main body; a piston sliding hole that is formed in the valve main body; a piston that is slidably provided in the piston sliding hole; a return-to-origin mechanism that returns the piston to an origin position; a traveling apparatus oil flow path that is formed such that the piston sliding hole passes through the valve main body; a winch oil flow path that is formed such that the piston sliding hole passes through the valve main body; and a sealing means for sealing both ends of the piston sliding hole in a hermetically sealed state, characterized in that the sealing means includes a positioning piece that protrudes towards the winch oil flow path side, the piston in the origin position is such that the positioning piece and an end portion of the piston are in contact, the piston includes a seal portion that is capable of sealing so that the traveling apparatus oil flow path and the winch oil flow path do not communicate through the piston sliding hole, and the piston slides to obstruct a flow of oil in the traveling apparatus oil flow path when pressure of the oil flowing to the winch oil flow path is high" is known (Patent Literature 2).

However, when a slope work vehicle using a valve such as this is used, while automatic response to an inclination of a slope can be made and adjustment to an appropriate hydraulic pressure can be made, a worker who is driving the slope work vehicle is unable to change distribution of hydraulic pressure as appropriate. There is risk of slight decrease in work efficiency.

Meanwhile, when the worker is able to arbitrarily adjust the hydraulic pressure for both the winch and the traveling apparatus, there is danger of the hydraulic pressure of the winch being reduced more than necessary, force holding the slope work vehicle to the slope decreasing, and the slope work vehicle falling.

[Patent Literature 1] Japanese Patent Laid-open Publication No. 2013-119739

[Patent Literature 2] Japanese Patent Publication No. 6726475

In light of conventional disadvantages such as those described above, an object of the present invention is to provide a slope work vehicle that is capable of efficiently moving and working on a slope, and is highly safe.

SUMMARY OF THE INVENTION

To achieve the above-described object, a slope work vehicle according to a first aspect of the present invention is a slope work vehicle that is capable of traveling on a slope and performing work, the slope work vehicle being configured by: a work vehicle main body that includes an operating seat; a traveling apparatus that is provided in the work vehicle main body and of which a control state changes depending on operations by a worker in the operating seat; a winch that is provided in the work vehicle main body; a traveling apparatus actuator that is connected to the traveling apparatus and drives the traveling apparatus; a winch actuator that is connected to the winch and drives the winch; a hydraulic pump that supplies oil to the traveling apparatus actuator and the winch actuator; a flow amount adjustment valve that is provided between the hydraulic pump and the traveling apparatus actuator; and a control means for controlling the flow amount adjustment valve, characterized in that at least either of the control means and the flow amount adjustment valve is capable of adjusting the supply of oil so that the slope work vehicle does not fall from the slope when the slope work vehicle is positioned on the slope. Preferably, the slope work vehicle is a slope work vehicle that is capable of traveling on a slope and performing work on the slope, the slope work vehicle being configured by: a work vehicle main body that includes an operating seat; a pair of left and right traveling apparatuses that are provided in the work vehicle main body; a pair of left and right winches that are provided in the work vehicle main body; traveling apparatus actuators that are respectively connected to the pair of left and right traveling apparatuses and drive the traveling apparatuses; winch actuators that are respectively connected to the pair of left and right winches and drive the winches; a hydraulic pump that supplies oil to the traveling apparatus actuators and the winch actuators; a flow amount adjustment valve that is provided between the hydraulic pump and the traveling apparatus actuators; and a control means for controlling the flow amount adjustment valve and that is capable of being operated from the operating seat, characterized in that at least either of the control means and the flow amount adjustment valve is capable of adjusting the supply of oil so that the slope work vehicle does not fall from the slope when the slope work vehicle is positioned on the slope The work vehicle main body of the slope work vehicle according to a second aspect is characterized by being provided with a work machine that has the operating seat.

The control means of the slope work vehicle according to a third aspect is characterized by including a sensor that senses a tilt of the work vehicle main body and controlling an oil supply amount to the traveling apparatus actuator based on the tilt of the work vehicle main body.

The traveling apparatus actuator of the slope work vehicle according to a fourth aspect characterized in that the traveling apparatus actuator, the winch actuator, the hydraulic pump, the flow amount adjustment valve, and the control means are respectively provided in pairs; one hydraulic pump supplies oil through one flow amount adjustment valve to one traveling apparatus actuator connected to one traveling apparatus, and supplies oil to one winch actuator connected to one winch; the other hydraulic pump supplies oil through the other flow amount adjustment valve to the other traveling apparatus actuator connected to the other traveling apparatus, and supplies oil to the other winch actuator connected to the other winch, and the one flow amount adjustment valve is controlled by one control means and the other flow amount adjustment valve is controlled by the other control means.

Effects of the Invention

As is clear from the descriptions above, effects listed as follows are achieved in the present invention.

(1) In the invention according to the first aspect, the oil supply amount supplied to the traveling apparatus can be adjusted by manual operation by a worker in the operating seat. Therefore, the oil supplied to the traveling apparatus can be adjusted as appropriate depending on the inclination of the slope, and the slope work vehicle can efficiently move on the slope.

(2) The control means or the flow amount adjustment valve can adjust the supply of oil so that the slope work vehicle does not fall from the slope. Therefore, the slope work vehicle accidentally falling as a result of tractive force of the winch being lost can be prevented.

(3) In the invention according to the second aspect, in addition to effects similar to above-described (1) and (2) being achieved, various work can be performed on the slope using heavy machinery.

(4) In the invention according to the third aspect, in addition to effects similar to above-described (1) to (3) being achieved, the supply of oil can be more reliably controlled.

(5) In the invention according to the fourth aspect, in addition to effects similar to above-described (1) to (3) being achieved, because the left and right traveling apparatuses and the like can be individually controlled and driven, the slope work vehicle can efficiently move on the slope.

BRIEF DESCRIPTION OF THE DRAWING

FIG. 1 is a side view of a slope work vehicle according to a first embodiment;

FIG. 2 is a planar view of the slope work vehicle;

FIG. 3 is an explanatory diagram of a hydraulic circuit;

FIG. 4 is a planar view during slope traveling;

FIG. 5 is a side view during slope traveling;

FIG. 6 is a side view of a slope work vehicle according to a second embodiment;

FIG. 7 is a planar view of the slope work vehicle;

FIG. 8 is an explanatory diagram of a hydraulic circuit;

FIG. 9 is a side view of a slope work vehicle according to a third embodiment; and FIG. 10 is a planar view of the slope work vehicle.

EXPLANATION OF REFERENCE NUMBERS

Figure 1:
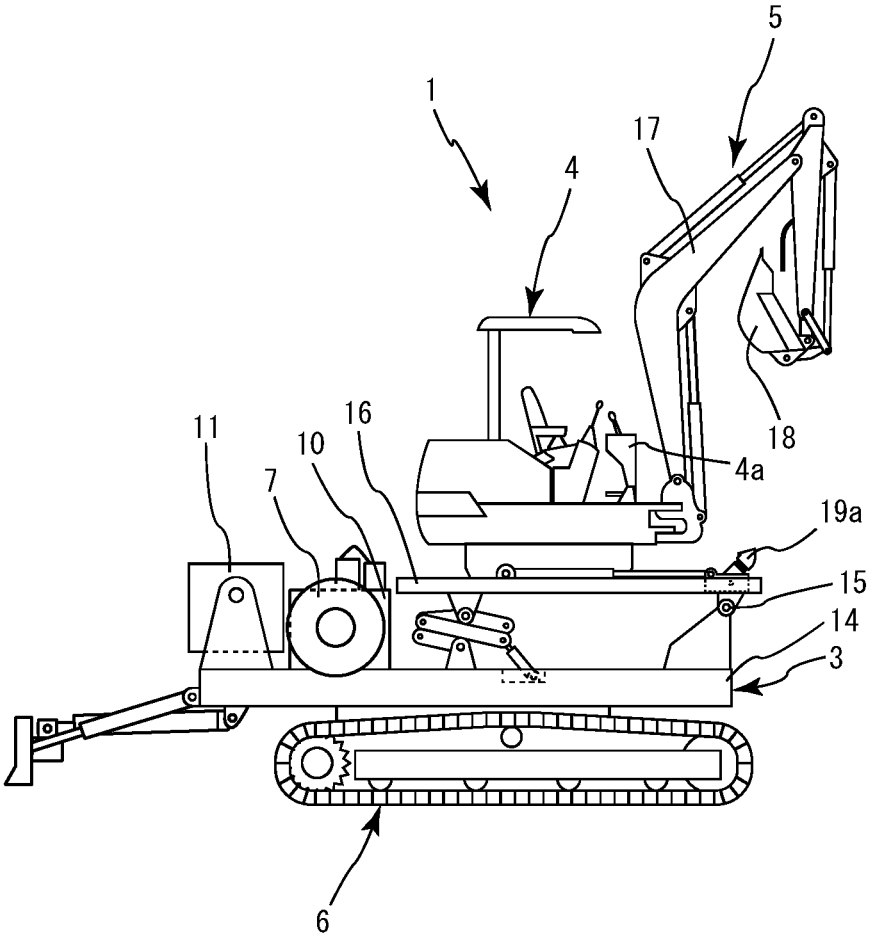
FIG. 1 to FIG. 5 are explanatory diagrams according to a first embodiment of the present invention.

1, 1A, 1B: slope work vehicle
2: slope
3: work vehicle main body
4, 4A: operating seat
5: work machine
6: traveling apparatus
7: winch
8: traveling apparatus actuator
9: winch actuator
10: hydraulic pump
11: engine
12, 12A: flow amount adjustment valve
13, 13A: control means
14: support base
15: pivot pin
16: base plate
17: drive arm
18: bucket
19: wire
20: main anchor
21, 21A: hydraulic circuit
22: sensor
23: work base

DETAILED DESCRIPTION OF THE PREFERRED EMBODIMENTS

The present invention will hereinafter be described in detail according to embodiments for carrying out the present invention shown in the drawings. Here, a left/right direction is a left/right direction in FIG. 2 (planar view). A front/rear direction is a left/right direction in FIG. 1. An up/down direction is an up/down direction in FIG. 1.

According to a first embodiment for carrying out the present invention shown in FIG. 1 to FIG. 5, 1 denotes a slope work vehicle that is mainly capable of working on a slope 2 that has a steep gradient shape of at least 40 degrees or greater. The slope work vehicle 1 is configured by a work vehicle main body 3 that is capable of traveling and a work machine 5 having an operating seat 4, such as a hydraulic shovel, that is provided in the work vehicle main body 3.

Figure 2:
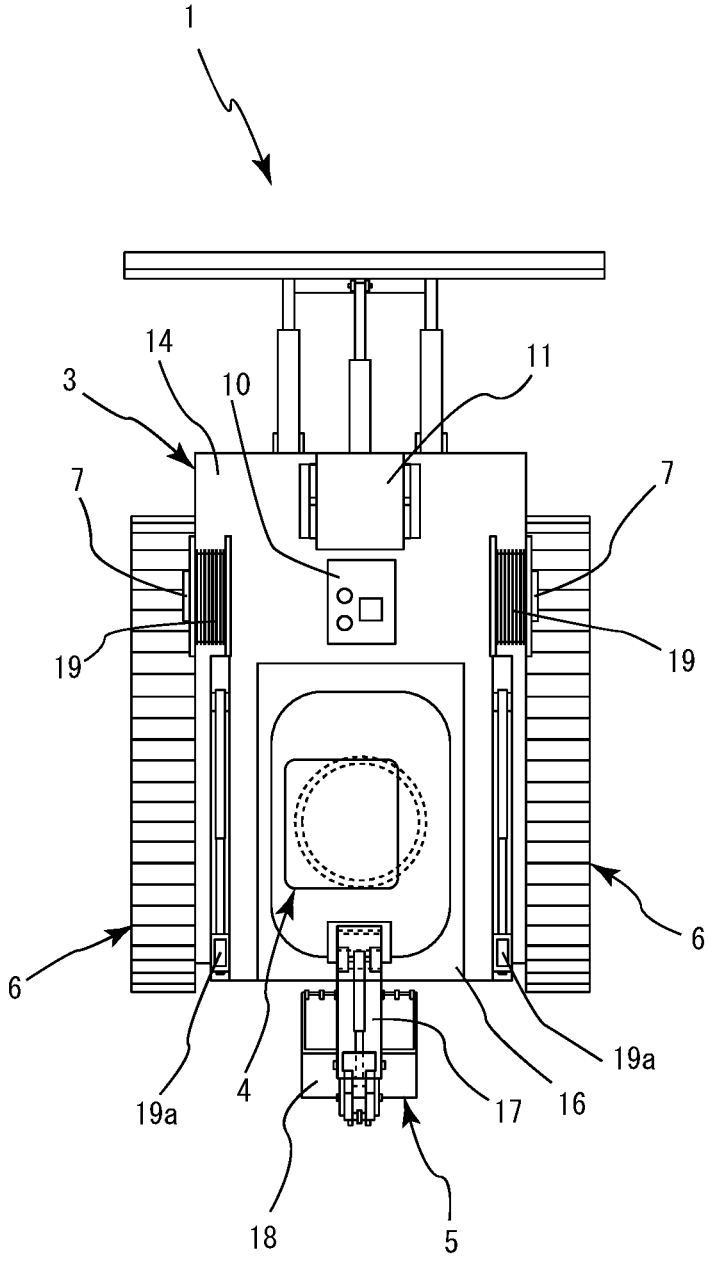

Specifically, as shown in FIG. 1 and FIG. 2, the slope work vehicle 1 is configured by: the work vehicle main body 3 that includes the work machine 5 having the operating seat 4 that can be manually operated by a worker; a pair of left and right traveling apparatuses 6 that are provided in the work vehicle main body 3; a pair of left and right winches 7 that are provided in the work vehicle main body 3; traveling apparatus actuators 8 that are respectively connected to the pair of left and right traveling apparatuses 6 and drive the traveling apparatuses 6; winch actuators 9 that are respectively connected to the pair of left and right winches 7 and drive the winches 7; a hydraulic pump 10 that supplies oil to the pair of traveling apparatus actuators 8 and the pair of winch actuators 9, an engine 11 for operating the hydraulic pump 10, a flow amount adjustment valve 12 that is provided between the hydraulic pump 10 and the traveling apparatus actuators 8, and a control means 13 that can be operated from the operating seat 4 and controls the flow amount adjustment valve 12.

The work machine 5 is provided in an upper portion of the work vehicle main body 3. According to the present embodiment, the work machine 5 includes: a base plate 16 of which one end portion is attached by a pivot pin 15 to a support base 14 that is formed protruding from a front upper portion of the work vehicle main body 3 to enable rotation of the other end portion in an up/down direction; the operating seat 4 that is attached onto the base plate 16 and operates a drive arm 17, a bucket 18, the traveling apparatuses 6, and the control means 13; the drive arm 17 that is attached to a front end portion of the operating seat 4; and the bucket 18, a breaker, or the like that serves as a work attachment that is detachably attached to a tip end portion of the drive arm 17. The work machine 5 is capable of performing work similar to that of a so-called hydraulic shovel on the slope 2.

The traveling apparatus 6 according to the present embodiment uses caterpillars 6. The caterpillars 6 are driven by the traveling apparatus actuators 8 that are connected to the hydraulic pump 10. Here, in the present invention, the flow amount adjustment valve 12 is provided between the hydraulic pump 10 and the traveling apparatus actuators 8. An opening of the flow amount adjustment valve 12 can be adjusted by the control means 13 being operated from the operating seat 4.

The pair of winches 7 are provided in left and right sections on a rear side of the work vehicle main body 3. Each winch 7 includes a wire 19. As a result of the wires 19 being fixed to main anchors 20 in an upper portion of the slope 2 and the winches 7 being wound, traveling can be performed even on the slope 2 having a steep angle. In the present invention, a slope that has a steep gradient shape with an inclination of 40 degrees or greater is assumed. However, for example, even on the slope 2 that is like a substantially vertical wall surface, the work vehicle main body 3 can be positioned in an arbitrary position on the slope 2 by being supported by the wires 19 that are connected to the two winches 7, and perform work.

The winch 7 is driven by the winch actuator 9 that is connected to the hydraulic pump 10.

Here, the engine 11 for operating the hydraulic pump 10 is rotatably provided in the work vehicle main body 3. As a result of the engine 11 being provided in this manner, even when moving on the slope 2, the engine 11 can maintain a substantially horizontal state at all times due to gravity, and seizure of the engine 11 and the like can be prevented.

Figure 3:
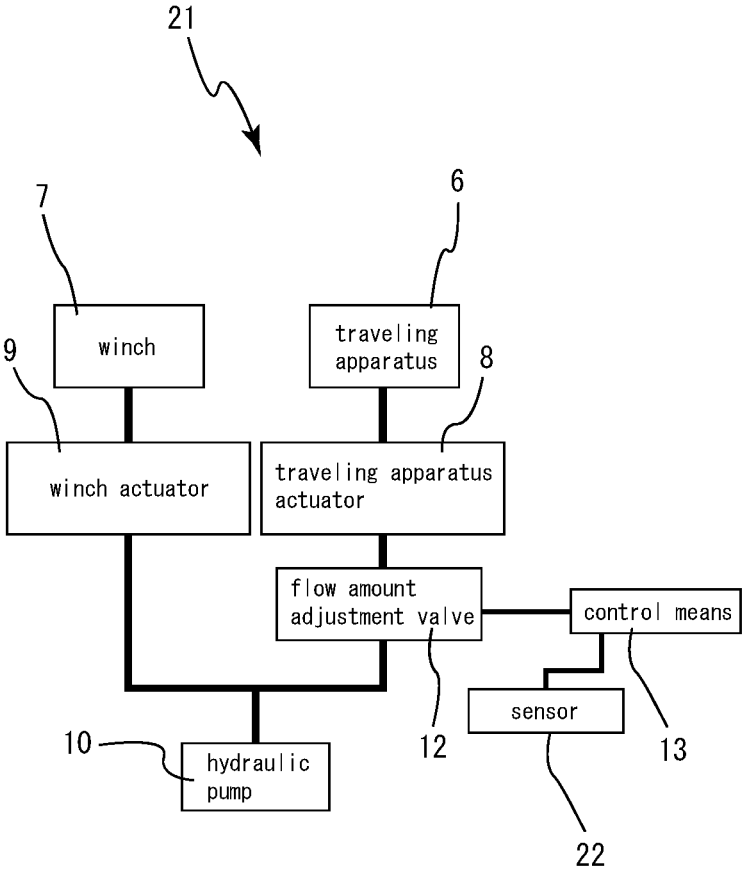

As shown in FIG. 3, a hydraulic circuit 21 according to the present embodiment is configured such that the hydraulic pump 10 supplies oil as a pressure medium to the traveling apparatus actuators 8 connected to the traveling apparatuses 6 and the winch actuators 9 connected to the winches 7.

In addition, according to the present embodiment, the flow amount adjustment valve 12 is provided on a flow path connecting the hydraulic pump 10 and the traveling apparatus actuators 8, and the control means 13 for controlling the flow amount adjustment valve 12 is provided.

According to the present embodiment, a needle valve 12 is used as the flow amount adjustment valve 12. The control means 13 for adjusting an opening of the needle valve 12 is provided in the operating seat 4. For example, as the control means 13, a control means that receives input of the inclination angle of the slope and sets an oil supply amount for the traveling apparatus actuators 8, or a control means that receives input of the opening of the flow amount adjustment valve 12 and sets the oil supply amount for the traveling apparatus actuators 8 can be considered.

As the needle valve, an electrical needle valve is preferably used and electrically controlled from the operating seat 4. However, for example, the control means 13 that performs control by a handle of the needle valve 12 being directly operated from a driver's seat is also possible.

The control means 13 is set to restrict (adjust) the supply of oil to the traveling apparatus actuators 8 when the work vehicle main body 3 is positioned on the slope 2 so that the work vehicle main body 3 does not fall from the slope 2.

That is, the flow amount adjustment valve 12 can be controlled from the operating seat 4 through the control means 13 provided in the operating seat 4 or near an operating panel 4*a* near the operating seat 4. However, in a case in which the control means 13 is operated in a state in which the slope work vehicle 1 is positioned on the slope 2 that is close to substantially vertical or the like, and an operation to increase oil supply to the traveling apparatuses 6 (reduce oil supply to the winches 7) is performed, the operation is invalidated. As a result of control to increase the oil supply amount to the traveling apparatus actuators 8 being hindered, the slope work vehicle 1 is prevented from falling.

Specifically, the configuration may be such that a sensor 22, such as a gyro sensor, that is provided in the work vehicle main body 3 and senses a tilt of the work vehicle main body 3 is connected to the control means 13, a maximum value of the opening of the flow amount adjustment valve 12 is controlled based on the tilt of the work vehicle main body 3, and a maximum value of the oil supply amount to the traveling apparatus actuator 8 is controlled. Here, a contact sensor, an area sensor, or the like that senses contact with a flat surface or a gradual slope may also be provided in a rear portion of the work vehicle main body 3, or on a soil removal plate or the like provided in a rear end portion of the work vehicle main body 3. In a case in which the contact sensor or the like detects contact of the work vehicle main body 3 with a flat surface or the like, even when the tilt of the work vehicle main body 3 or the like is unchanged, the control means 13 may be capable of controlling the maximum value of the opening of the flow amount adjustment valve 12 and supplying more oil to the traveling apparatuses 5.

Meanwhile, increase in the oil supply amount to the winch actuators 9 need not be restricted.

Here, "falling" refers to the slope work vehicle 1 moving downward at a speed at which the worker will be injured or the slope work vehicle 1 will be damaged, or higher. A state in which the slope work vehicle 1 moves downward very slowly is not included in the "falling" referred to herein.

Through use of the flow amount adjustment valve 12 and the control means 13 such as these, when the slope 2 becomes an angle that is close to vertical from a steep angle, the opening of the flow amount adjustment valve 12 can be manually adjusted from the operating seat 4 using the control means 13, and the supply of oil to the traveling apparatuses 6 can be reduced or made almost none. The winches 7 can thereby be driven and the slope work vehicle 1 (work vehicle main body 3) moved upward. In addition, even when an erroneous operation of the control means 1 is performed, the slope work vehicle 1 falling from the slope 2, and the worker being injured or the slope work vehicle 1 and the like being damaged can be prevented.

Here, the supply of oil is adjusted using the control means 13 so that the slope work vehicle 1 does not fall from the slope 2. However, for example, the flow amount adjustment valve 12 that supplies sufficient oil to the winch actuators 9 even when fully open and prevents the slope work vehicle 1 from falling from the slope 2 may be used. In this case, falling of the slope work vehicle 1 can be prevented by the flow amount adjustment valve 12 alone, without use of the control means 13 and the sensor 22.

Hydraulic equipment other than the traveling apparatuses 6 and the winches 7, such as a hydraulic pump for operating the work machine 5, is preferably separately provided.

Figure 4:
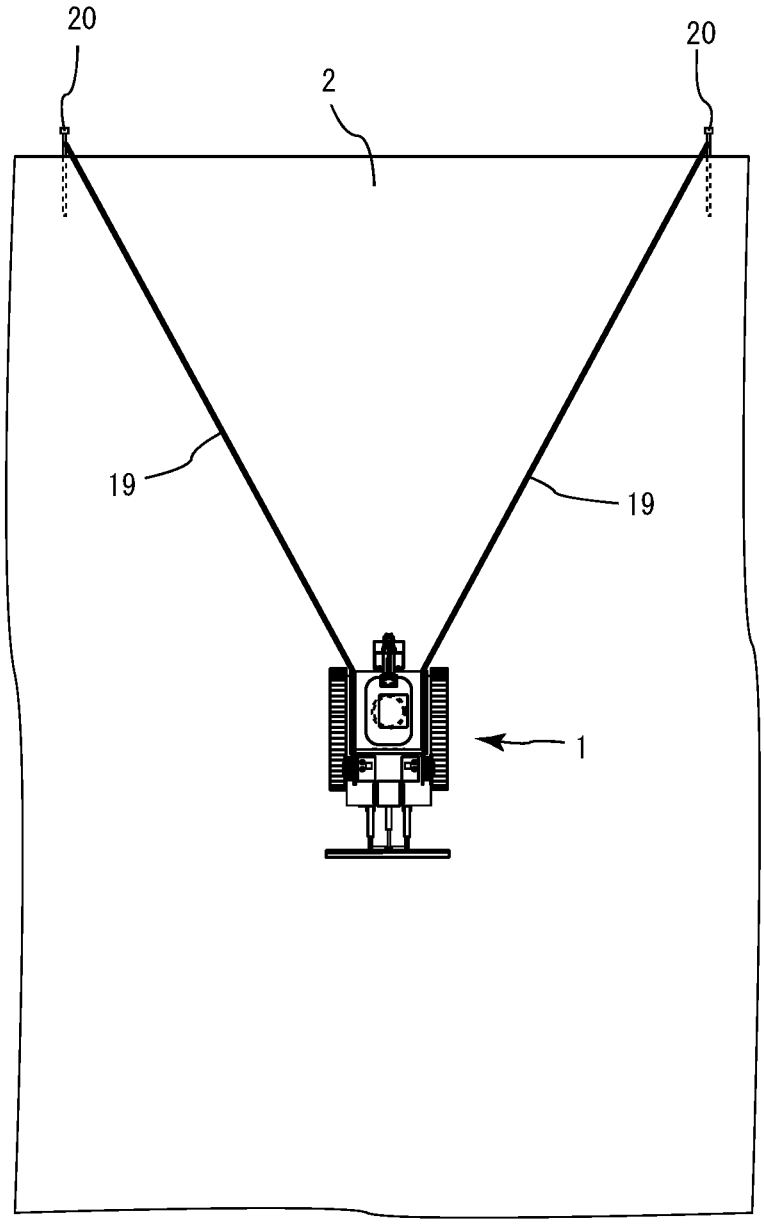
Figure 5:
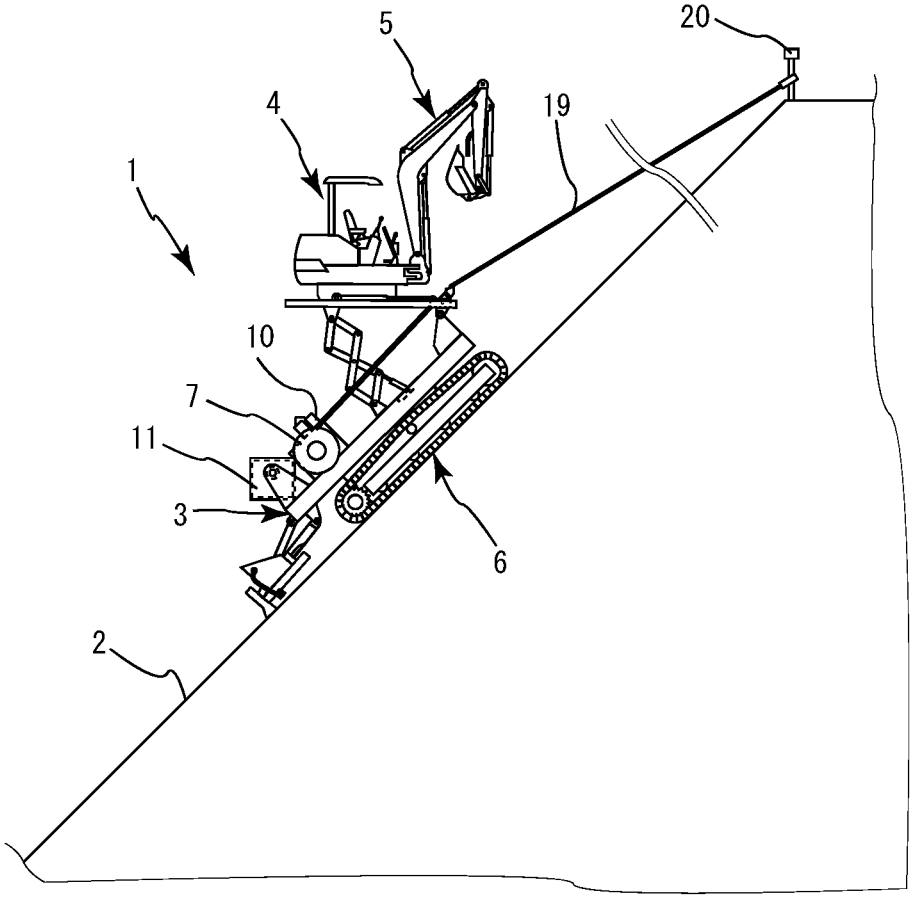

When working on the slope 2, the slope work vehicle 1 is positioned in a lower portion of the slope 2, and tip end portions of the wires 19 of the left and right winches 7 are fixed to the main anchors 20 in the slope upper portion. At this time, as shown in FIG. 4, the wires 19 are preferably fixed to form a V shape from a planar view. When the wires 19 are fixed to the main anchors 20, the control means 13 is operated to control the flow amount adjustment valve 12 to be set so that the oil pumped from the hydraulic pump 10 is appropriately distributed. Next, the hydraulic pump 10 is operated, and the slope work vehicle 1 is advanced by the winches 7 being wound and the traveling apparatuses 6 being operated.

Here, according to the present embodiment, the wires 19 are fixed to the main anchors 20 by wire fairleads 19*a* that are provided in left and right portions on a front side of the work vehicle main body 3.

When the slope work vehicle 1 arrives at a work position, work is performed on the slope by the work machine 5, Here, when the inclination changes midway through the slope 2, the control means 13 is operated in correspondence to the inclination of the slope 2 each time and the flow amount adjustment valve controls 12.

Other Embodiments for Carrying Out the Invention

Next, other embodiments for carrying out the present invention shown in FIG. 6 to FIG. 10 will be described. Here, in the descriptions of these other embodiments for carrying out the present invention, constituent sections identical to those according to the first embodiment for carrying out the present invention are given the same reference numbers. Redundant descriptions are omitted.

Figure 6:
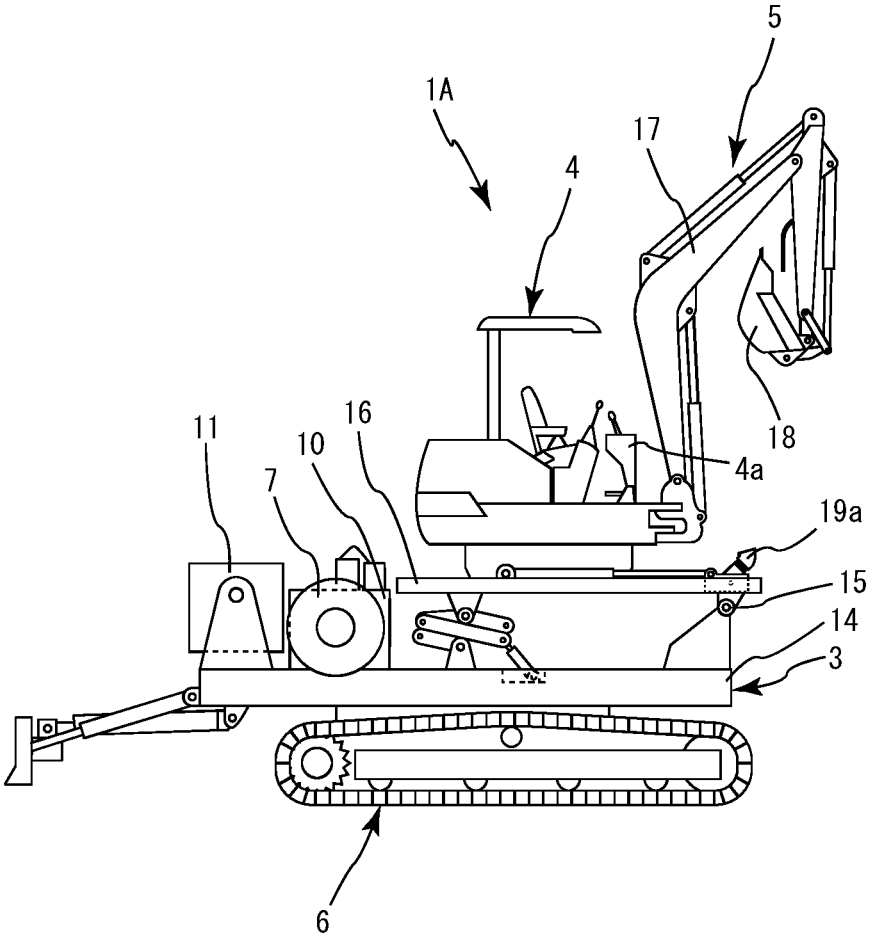
FIG. 6 to FIG. 8 are explanatory diagrams according to a second embodiment of the present invention.
Figure 7:
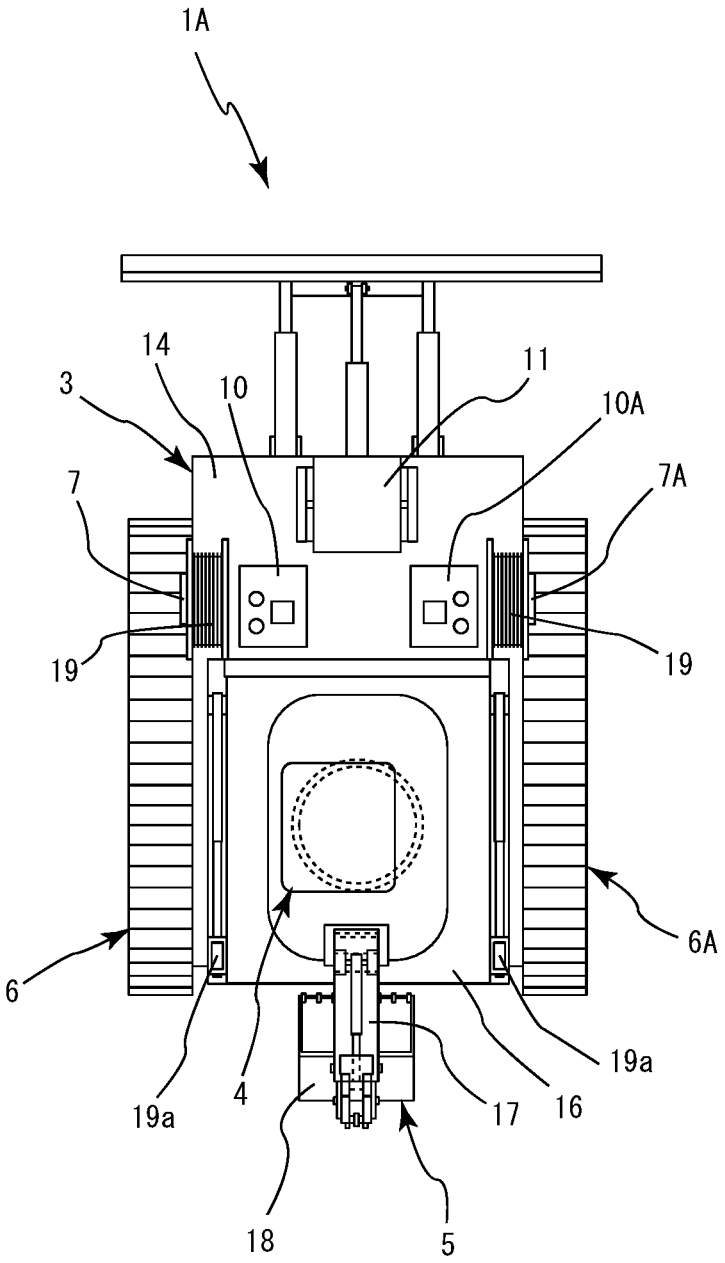
Figure 8:
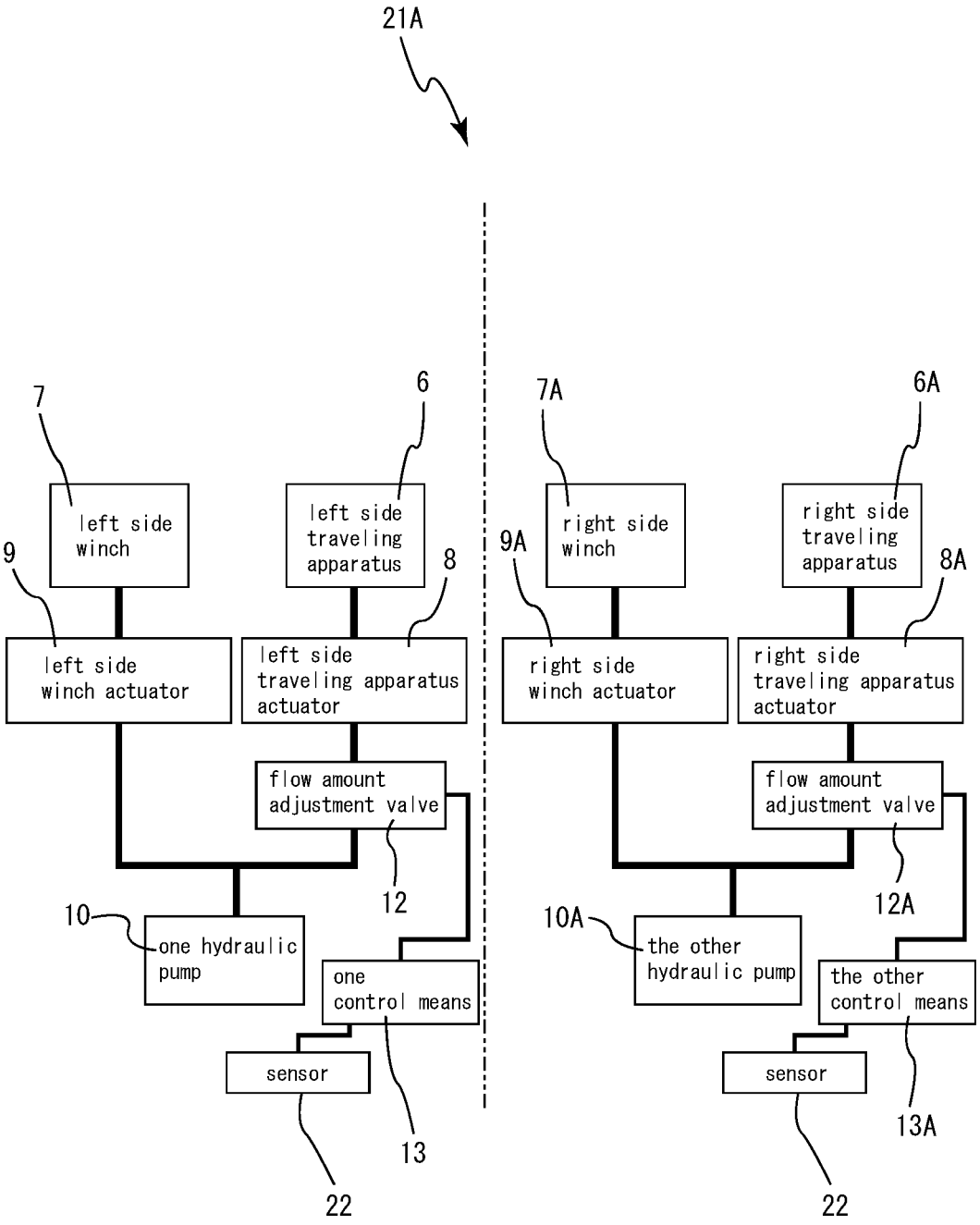

A second embodiment for carrying out the present invention shown in FIG. 6 to FIG. 8 mainly differs from the above-described first embodiment for carrying out the present invention in that hydraulic pumps 10 and 10A, flow amount adjustment valves 12 and 12A, and control means 13 and 13A are respectively provided in pairs, and a hydraulic circuit 21A is provided in which one hydraulic pump 10 supplies oil to one traveling apparatus actuator 8 connected to one traveling apparatus 6 (such as the traveling apparatus 6 provided on the left side of the work vehicle main body 3) through one flow amount adjustment valve 12 and supplies oil to one winch actuator 9 connected to one winch 7 (such as the winch 7 provided on the left side of the work vehicle main body 3), and the other hydraulic pump 10A supplies oil to the other traveling apparatus actuator 8A connected to the other traveling apparatus 6A (such as the traveling apparatus 6A provided on the right side of the work vehicle main body 3) through the other flow amount adjustment valve 12A and supplies oil to the other winch actuator 9A connected to the other winch 7A (such as the winch 7A provided on the right side of the work vehicle main body 3). Even in a slope work vehicle 1A such as this, working effects similar to those according to the above-described first embodiment for carrying out the present invention can be achieved.

According to the present embodiment, the one flow amount adjustment valve 12 that is provided between the traveling apparatus actuator 8 connected to the traveling apparatus 6 provided on the left side of the work vehicle main body 3 and the hydraulic pump 10 is controlled by the control means 13.

In addition, the other flow amount adjustment valve 12A that is provided between the traveling apparatus actuator 8A connected to the traveling apparatus 6A provided on the right side of the work vehicle main body 3 and the hydraulic pump 10A is controlled by the control means 13A.

The one and the other traveling apparatuses 6 and 6A and winches 7 and 7A can each be individually driven, and the flow amount adjustment valves 12 and 12A can be respectively controlled by the control means 13 and 13A. Therefore, the slope work vehicle 1A can more efficiently move on the slope 2.

Figure 9:
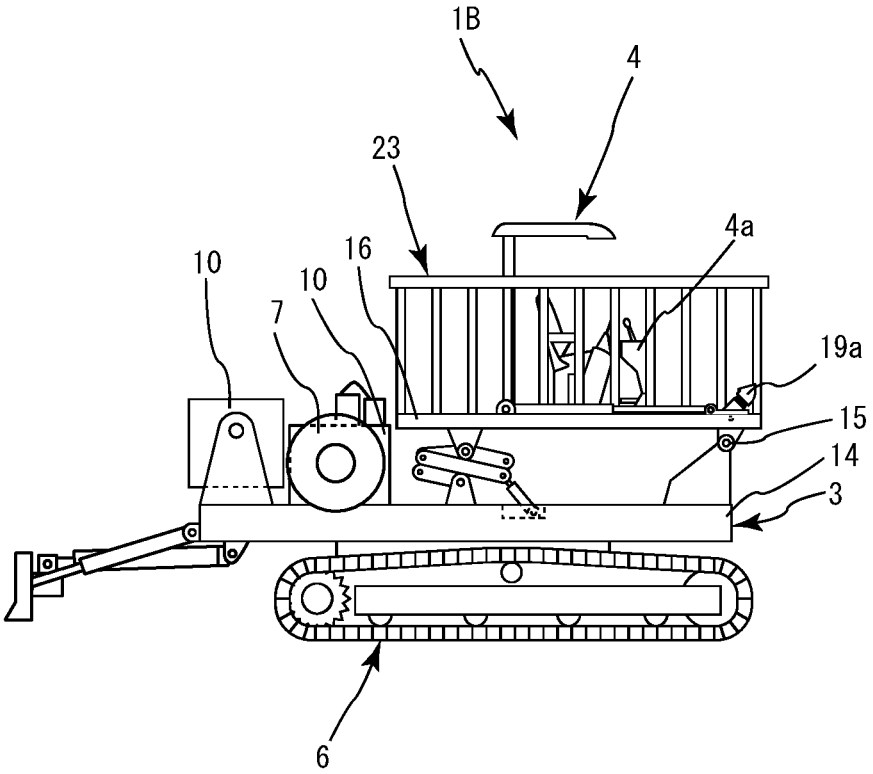
FIG. 9 and FIG. 10 are explanatory diagrams according to a third embodiment of the present invention.
Figure 10:
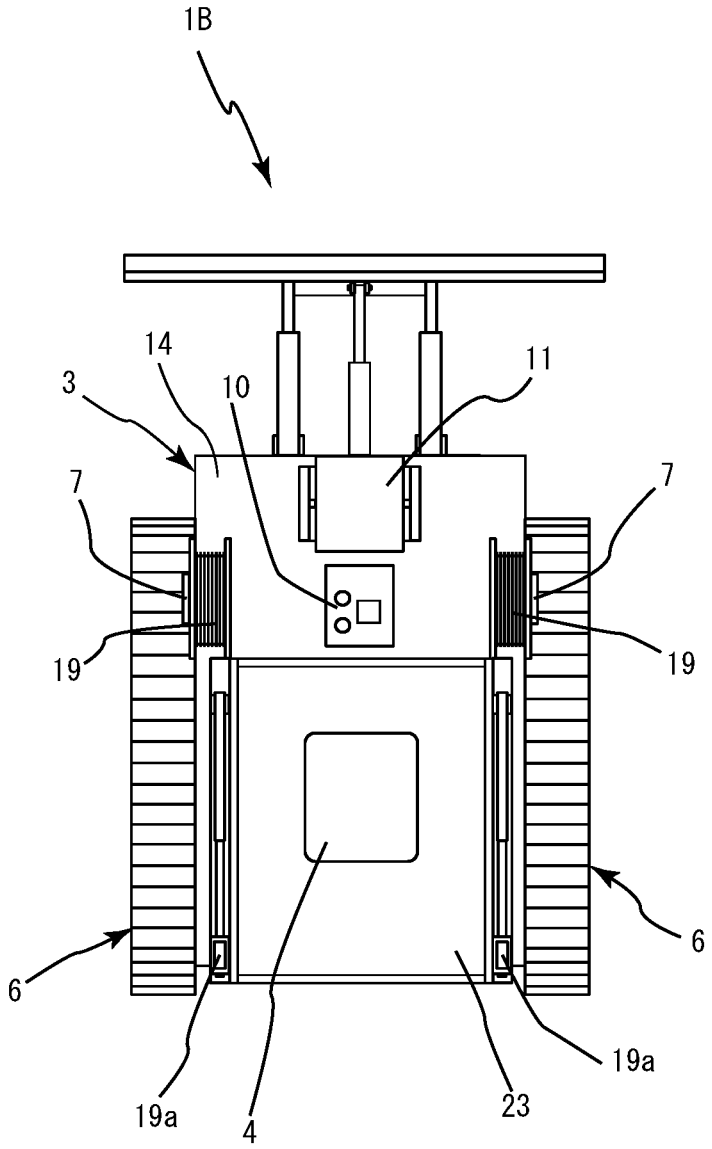

A third embodiment for carrying out the present invention shown in FIG. 9 and FIG. 10 mainly differs from the above-described first embodiment for carrying out the present invention in that only a work base 23 that has an operating seat 4A that is capable of operating the traveling apparatuses 6 and the control means 13 is provided in an upper portion of the work vehicle main body 3 without a work machine being provided, and the work machine 5 is not provided. Even in a slope work vehicle 1B such as this, working effects similar to those according to the above-described first embodiment for carrying out the present invention can be achieved.

The slope work vehicle 1B according to the present embodiment is provided with a work base 23 in the support base 14 of the work vehicle main body 3, with the pivot pin 15 and the base plate 16 therebetween, and is used in cases such as when an operator a worker mounts the work base 23 and work is performed on the slope 2. Here, the base plate 16 also serves as a bottom surface of the work base 23. A railing for preventing the worker from falling is provided around the work base 23.

Here, according to the embodiments of the present invention, a traveling apparatus that uses the caterpillars is described as the traveling apparatus. However, for example, a tire or the like that is driven by a hydraulic actuator may be used as the traveling apparatus.

In addition, a work machine that includes a so-called hydraulic shovel is described as the work machine. However, for example, so-called heavy machinery, such as a drilling apparatus, a crane, a pile driver, or a breaker, may be used.

Here, according to the embodiments of the present invention, the hydraulic pumps operating the traveling apparatuses and the winches are arranged in the left and right sections of the work vehicle main body. The hydraulic pump on the right side operates the traveling apparatus and the winch on the right side. The hydraulic pump on the left side operates the traveling apparatus and the winch on the left side. However, The hydraulic pump on the left side may operate the traveling apparatus and the winch on the right side, and the hydraulic pump on the right side may operate the traveling apparatus and the winch on the left side. The positions in which the hydraulic pumps are arranged can also be changed as appropriate.

INDUSTRIAL APPLICABILITY

The present invention is used in an industry that manufactures slope work vehicles used in cases in which the slope work vehicle is suspended and towed by a wire of a winch and performs various types of work on a sloping land having a steep gradient, such as a slope.

What is claimed is:

1. A slope work vehicle capable of traveling on a slope and performing work, the slope work vehicle comprising:

a work vehicle main body that includes an operating seat;

a traveling apparatus that is provided in the work vehicle main body and of which a control state changes depending on operations by a worker in the operating seat;

a winch that is provided in the work vehicle main body;

a traveling apparatus actuator that is connected to the traveling apparatus and drives the traveling apparatus;

a winch actuator that is connected to the winch and drives the winch;

a hydraulic pump that supplies oil to the traveling apparatus actuator and the winch actuator in parallel;

a single flow amount adjustment valve that is provided between the hydraulic pump and the traveling apparatus actuator and is configured to apportion the oil between the winch actuator and the traveling apparatus actuator;

a control means for controlling the flow amount adjustment valve; and a tilt sensor provided on the work vehicle main body that senses a tilt of the work vehicle and is connected to the control means, wherein the control means is configured to control the flow amount adjustment valve in response to tilt of the slope sensed by the tilt sensor so that a supply of oil is apportioned between the traveling apparatus actuator and the winch actuator so that the slope work vehicle does not fall from the slope when the slope work vehicle is positioned on the slope;

the flow amount adjustment valve is configured also to be adjusted manually directly or through the control means independently of the tilt sensor by an operator of the work vehicle seated in an operating seat in the vehicle main body; and the control means is configured also to prevent manual adjustment of the flow amount adjustment valve to decrease supply of oil to the winch actuator when the slope approaches being vertical.

2. The slope work vehicle according to claim 1 wherein:

the work vehicle main body is provided with a work machine that has the operating seat.

3. The slope work vehicle according to claim 1 or claim 2, wherein:

the traveling apparatus actuator, the winch actuator, the hydraulic pump, the flow amount adjustment valve, the control means, and the sensor are respectively provided in pairs, one hydraulic pump supplies oil through one flow amount adjustment valve to one traveling apparatus actuator connected to one traveling apparatus, and supplies oil to one winch actuator connected to one winch, the other hydraulic pump supplies oil through the other flow amount adjustment valve to the other traveling apparatus actuator connected to the other traveling apparatus, and supplies oil to the other winch actuator connected to the other winch, the one flow amount adjustment valve is controlled by one control means and the other flow amount adjustment valve is controlled by the other control means, and the one tilt sensor is configured to control the one flow amount adjustment valve and the other tilt sensor is configured to control the other flow amount adjustment valve.

* * * * *